United States Patent [19]
Thompson
[11] 4,055,017
[45] Oct. 25, 1977

[54] MINI BENCH REST

[76] Inventor: Harold Thompson, P.O. Box 8002, Boise, Idaho 83707

[21] Appl. No.: 609,277

[22] Filed: Sept. 2, 1975

[51] Int. Cl.² ..... F41C 29/00
[52] U.S. Cl. ..... 42/94
[58] Field of Search ..... 42/94; 89/37 BA

[56] References Cited

U.S. PATENT DOCUMENTS 1,375,487 4/1921 Bulter et al. ..... 42/94
2,870,683 1/1959 Wilson ..... 42/94
3,012,350 12/1961 Wold ..... 42/94

*Primary Examiner*—Charles T. Jordan

[57] ABSTRACT

The bench rest of this invention comprises a mounting base being adapted to permit articulation for both pitch and yaw; and a bench having a beam mounted to said collar, and having a front support rest. The front support rest is adjustable for elevation with respect to the main plane of the beam. The beam also includes a detachably mounted rear support for long barrel guns, such as rifles.

5 Claims, 5 Drawing Figures

MINI BENCH REST

Field of the Invention

The present invention relates to fire arm accessories, and more particularly to a rest supporting fire arms during target shooting and the like.

BACKGROUND OF THE INVENTION

A rest is any means of supporting a gun, most frequently a rifle, while firing it. Modified bench rest cradle a rifle to permit the shooter to operate all mechanisms. For sighting, the shooter may use a rest fabricated of leather bags or tightly woven canvas bags filled to maximum capacity with fine sand. The foreend of the rifle usually lies on the rest with the toe of the butt being rested either on another, slightly smaller sand bag or on the clinched left fist of the shooter if he is right-handed. Pedestal rests constitute a second important type of rest, wherein the rest carries an especially shaped rubber sand bag, and another shaped bag supports the rifle at the butt. It is generally recognized that either type of conventional rest is unsatisfactory, because the contents of the bags necessarily shift with each discharge of the gun.

Accordingly it is an object of the present invention to provide a bench rest which is structurally rigid, while permitting the rest to absorb recoil.

It is a further object of this invention that the aforesaid bench rest be adjustable for angle of discharge.

It is still another object of this invention that the aforesaid invention be adaptable to carry target pistols.

It is an object of this invention that the present bench rest be adaptable to demountable construction.

These and other objects shall become apparent from the description following, it being understood that modifications may be made without affecting the teachings of the invention here set out.

SUMMARY OF THE INVENTION

The bench rest of this invention comprises a mounting base being adapted to permit articulation for both pitch and yaw; and a bench having a beam mounted to said collar, and having a front support rest. The front support rest is adjustible for elevation with respect to the main plane of the beam. The beam also includes a detachably mounted rear support for long barrel guns, such as rifles.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
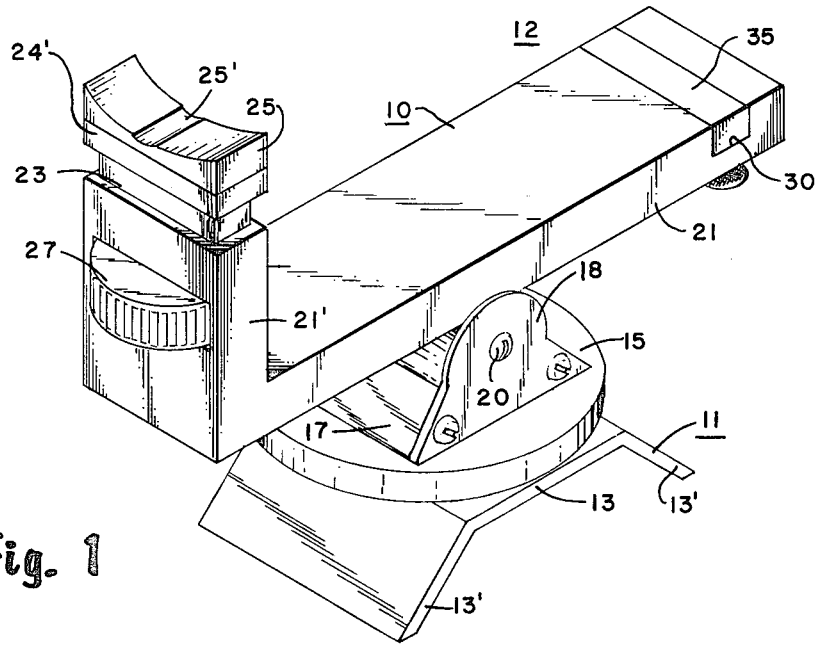
FIG. 1 is a perspective view of the bench rest of this invention.
Figure 1A:
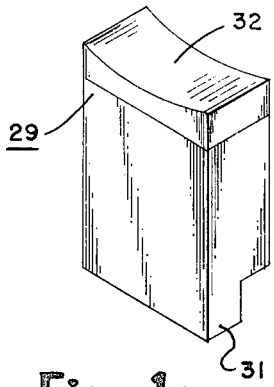
FIG. 1*a* is a perspective view of the removable rear support block employed herein.
Figure 2A:
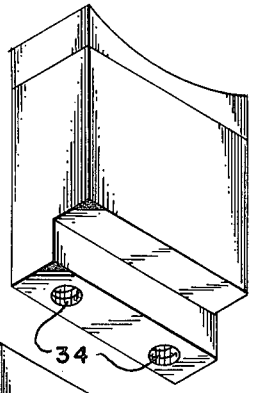
FIG. 2*a* is a bottom rear perspective view of the rear rest of the FIG. 1*a*.
Figure 2:
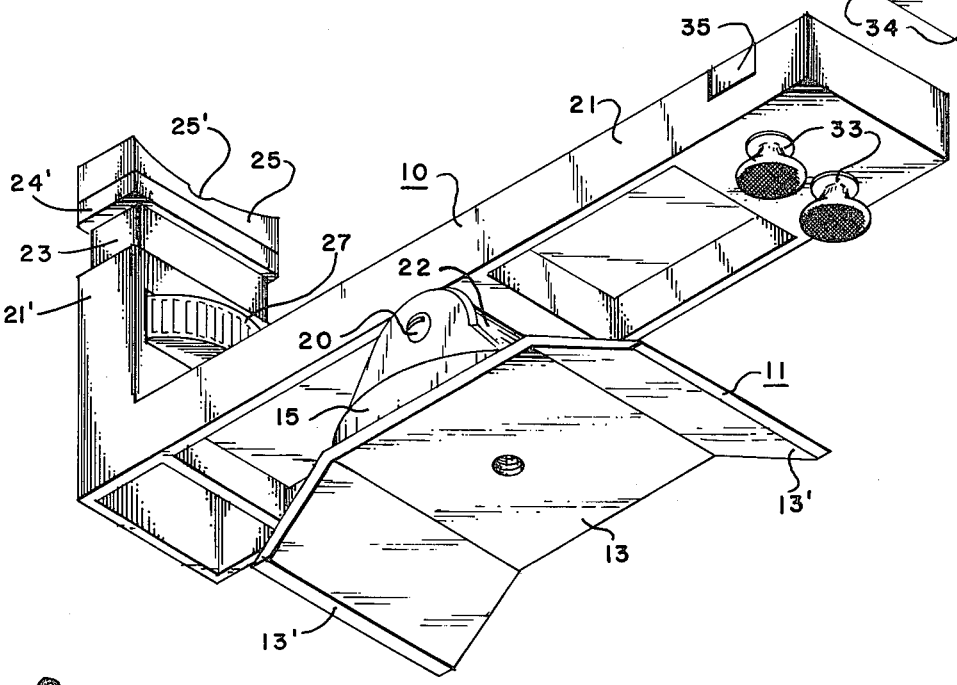
FIG. 2 is a bottom perspective view of the side opposite the FIG. 1 of the present bench rest.

Referring now to the drawings and more particularly to FIGS. 1 and 2, the bench rest of this invention is shown to advantage and generally identified with the numeral 10. The rest comprises a base 11, and bench assembly 12.

Figure 3:
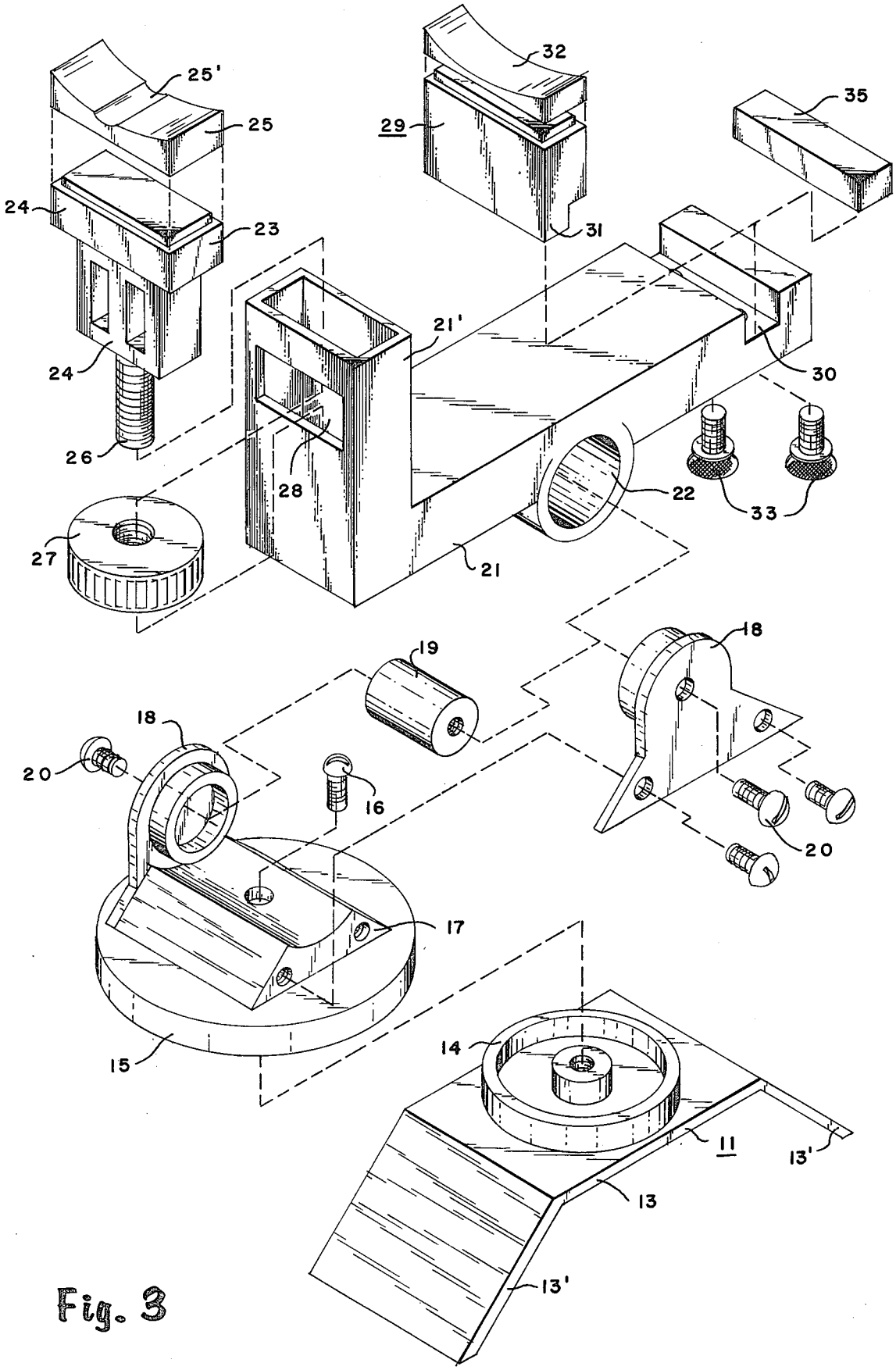
FIG. 3 is an exploded view of the present bench rest.

The base 11 comprises a mounting flange 13 by which the base 11 may be mounted to a structural member (not shown). The mounting flange 13 may be provided with suitably bent mounting leaves 13', which issue from each side of the main flat plate forming the flange 13. As shown more clearly in the FIG. 3, an annular base ring 14 is mounted to the uppermost terminal side of the flange 13, to have a substantially horizontal orientation under normal mounting conditions. An annular collar 15 slides about the outer periphery of the ring 14, and is secured by a locking screw 16. A journal bracket 17 is disposed on the uppermost terminal side of the collar 15, and provides means mounting the bench assembly 12 to the base 11. The bracket 17 includes a pair of upwardly issuing, opposingly disposed boring cups 18. The cups 18, in turn, carry a cylindrical shaft 19, which is secured in the cups 18 by screws 20.

The bench assembly 12 includes an L-shaped beam 21 which is mounted midway in the longer of its legs to the base 11. The beam 21 is provided with a hollow cylindrical bushing 22 which is disposed midway in and transversely to the elongated leg of the beam 21. The shaft 19 rides fictionlessly within the bushing 22. It is seen that the base 11 is operable to provide articulation along the horizontal and vertical axes for both pitch and yaw of the beam 21 with respect to the base 11.

The shorter outstanding leg of the L-shaped beam 21 provides a forward rest support 21'. It is intended that the forward rest 21' be fabricated in a hollow polygonal cross-section. The hollow polygonal cavity formed in the forward support 21' is intended to carry a front support block subassembly 23. Referring now to the FIGS. 1 and 3, the forward block subassembly 23 comprises a rigid block having a polygonal cross-section which may fictionlessly, and contiguously engage the cavity formed in the support 21'. The uppermost terminal end of the block 24 may be provided with an oversized flange portion 24' which may engage the uppermost terminal end of the edge of the support 21' when the block 24 is fully engaged therein. The uppermost terminal end of the block 24 is further provided with a hard rubber rest pad 25. It has been found to advantage to configure the uppermost terminal edge of the pad 25 with a concave recess disposed parallelly to the rectilinear axis of the beam 21, to permit the barrel of a gun to find a stable seat in the subassembly 23. A centrally disposed groove 25' may be provided at the lowest point of curvature of the recess in the pad 25 to further accomplish the latter object. The lowermost terminal end of the block 24 is provided with a dominantly issuing threaded shaft 26. The shaft 26 is intended to engage a threaded thumbwheel 27. The thumbwheel 27 is carried transversely in a slotted window 28 which is provided in a support 21'. In operation the shaft 26 is engaged into the thumbwheel 27, which is in turn carried in the window 28. The rectangular cross-section of the block 24 is guided by the corresponding interior walls of the support 21'. As the thumbwheel 27 is rotated the shaft 26 is driven either upwardly or downwardly with respect to the beam 21, thus providing an adjustment for elevation, and for height with respect to the beam 21.

Referring again to the FIGS. 1 and 2, and FIGS. 1*a* and 2*a,* the rest 10 further includes a rear-support rest 29. The support 29 is detachably mounted at the end of the longer horizontal leg of the beam 21 opposite the front support 21'. The rear support 29 is demountably carried in a keyway 30 disposed transversely in the uppermost terminal side of the horizontal portion of the beam 21, at the end opposite the support 21'. A corresponding key 31 issues downwardly from the lowermost terminal edge of the support 29. As with the block subassembly 23 the uppermost terminal end of the support 29 is provided with a hard rubber pad 32, which may be concave from above. The support 29 is secured to the beam 21 by locking screws 33 which are mounted from the lowermost terminal side of the beam through to the keyway 30. The locking screws 33 engage threaded holes 34 in the lowermost terminal side of the key 31.

The rest 10 is also adaptable for target pistol shooting applications. Under the latter application, the barrel of a pistol is rested on the forward support 21', with the lower end of the pistol grip resting on the upperside of the horizontal leg of the beam 21. As shown in the FIGS. 1 and 3 a filler blank 35 is employed to fill the keyway 30. In the manner similar to the support 29, threaded holes (not shown) are provided in the lowermost terminal side of the blank 35, which engage the screws 33.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A bench rest, comprising:

a base including a mounting flange, an annular base ring mounted to the uppermost terminal side of said base flange to have a substantially horizontal orientation under normal mounting conditions; an annular collar journally mounted about the outer periphery of said ring, and a journal bracket issuing from the uppermost terminal side of said collar, said bracket carrying a journally mounted cylindrical shaft disposed along the horizontal plane with respect to said base; and a bench assembly including an L-shaped beam having an upstanding leg and a generally horizontally disposed leg, said beam being mounted midway in the horizontal leg to said shaft of said base, the upstanding leg of said beam having a hollow polygonal cross-section, forming a cavity, a front support block subassembly including a block having the same exterior configuration as, and sliding closely in said cavity in said upstanding leg of said beam, the lowermost terminal end of said block having a dominantly projecting threaded shaft, and a thumbwheel disposed transversely through a window in said upstanding leg of said beam being engageable with said threaded shaft.

2. The apparatus of claim 1 wherein the uppermost terminal side of said support block is provided with an elastomeric pad which has a concave recess in its uppermost terminal side, said recess being disposed parallelly to the rectilinear axis of said beam.

3. The apparatus of claim 2 including a groove cut rectilinearly at the lowest point of curvature of said concave recess.

4. The apparatus of claim 1 including a demountably carried rear support block comprising a rear support block having a key at it lowermost terminal side which is engageable with a keyway disposed transversely in the uppermost terminal side of said horizontal leg of said beam at the end opposite of said forward support, and means detachably locking said rear support block key into said beam keyway.

5. The apparatus of claim 4 wherein the uppermost terminal end of said rear support block is provided with an elastomeric pad having a concave recess on its uppermost terminal side.

* * * * *